United States Patent [19]

Huff

[11] Patent Number: 4,901,683

[45] Date of Patent: Feb. 20, 1990

[54] VENTED VALVE FOR INTERNAL COMBUSTION ENGINES

[76] Inventor: Reggie D. Huff, 12505 SW. North Dakota #906, Tigard, Oreg. 97223

[21] Appl. No.: 405,581

[22] Filed: Aug. 24, 1989

Related U.S. Application Data

[63] Continuation of Ser. No. 193,036, May 12, 1988, abandoned.

[51] Int. Cl.[4] ..... F01L 1/28

[52] U.S. Cl. ..... 123/79 C

[58] Field of Search ..... 123/79 R, 79 C, 188 AF, 123/188 VA

[56] References Cited

U.S. PATENT DOCUMENTS

| | | | |
|---|---|---|---|
| 2,439,618 | 4/1948 | Cloutier | 123/79 C |
| 3,060,916 | 10/1962 | Buchi | 123/79 C |
| 3,881,459 | 5/1975 | Gaetcke | 123/79 C X |
| 3,987,769 | 10/1976 | Yew | 123/188 VA |

FOREIGN PATENT DOCUMENTS

| | | | |
|---|---|---|---|
| 3600067 | 7/1987 | Fed. Rep. of Germany | 123/79 C |

*Primary Examiner*—Willis R. Wolfe

[57] ABSTRACT

A two part intake or exhaust valve comprising an inner and an outer valve, both circular in shape, with the inner valve having a longer stem of a smaller radius to extend above the outer valve. The outer valve has a hollow stem large enough to accept the inner valve, also a valve seat in the center of its bottom face to seat the inner valve, and the top side of its base is equipped with vents. Both valves have separate springs of appropriate size affixed under valve spring retainers and retainers locked in place with retainer locks. The inner valve is equipped with a groove under the retainer to accept a heavy clip or stop disc. The purpose of this valve mechanism is to create a two stage event when atmosphere enters or exits a combustion chamber. This will allow more atmosphere to enter or exit the combustion chamber than is possible with a single valve arrangement. In addition, this will cause two different speeds of atmospheric movement, creating low pressure in the center, via the inner valve, creating a vortexial storm or swirl effect. The result is more power and better fuel efficiency than can be realized with state of the art valve arrangements.

5 Claims, 4 Drawing Sheets

VENTED VALVE FOR INTERNAL COMBUSTION ENGINES

This is a continuation of Ser. No. 193,036, field 5/12/88, now abandoned.

BACKGROUND

The invention here disclosed relates to a reciprocating valve mechanism, and more particularly, a valve which controls the intake of air/fuel mixture and expelling of exhaust gases to and from the combustion chamber of internal combustion engines.

In typical internal combustion engines the valves that control the flow of atmosphere to and from the combustion chamber are one piece, with one spring retainer, and various spring control arrangements.

Since the efficiencey of this valve arrangement is a major factor in the performance of the entire engine, many attempts at maximizing the potential flow of these valves have been explored. In retrospect, since the atomizing of the fuel used to operate an engine is also a major factor in the performance of the entire engine, many attempts to use the one piece valve arrangement in different ways to crate a swirl effect have also been explored.

Increasing the flow of the valve automatically increases the power of the engine. Increasing the atomization of the fuel used, also, automatically increases the power of the engine by breaking down the fuel into smaller particles that can be more easily burned, but more importantly this increases the fuel economy and reduces the harmful emissions of internal combustion engines.

It is to these fundamental concepts of flow volume and fuel atomization that the here disclosed invention takes a giant step forward, by accomplishing both at the same time.

One of the more popular attempts at increasing the flow volume to and from the combustion chamber is the using of multiple valves operating side by side one another, but irrespective of one another, so that, instead of having one intake valve and one exhaust valve, there are either two intake and one exhaust, or two of each. Although the advantages of these arrangements as respects performance are obvious, the disadvantages are even more obvious. One disadvantage is the cost of manufacture. In order to accommodate the multiple valves the head of the engine, and infact, at times the main block of the engine have to be redesigned and the cam has to be redesigned as well. As the valves are multiplied then so are the parts needed to operate each valve. This means more rocker arms, pushrods and lifters, unless overhead cams are used, which means more complicated timing arrangements. Another disadvantage is that the cost of maintaining and servicing such arrangements can be greatly increased over conventional arrangements.

The invention here disclosed solves these problems by being able to be implemented into most internal combustion engine designs as such, with very minor modifications. Therefore, in addition to immediate savings, the cost of maintaining and servicing would be lower as well.

A U.S. Patent Search to 1979 revealed no applicable references. It is the belief of this inventor, and others knowledgeable in the art, that this concept has not been recognized before.

BRIEF SUMMARY OF INVENTION

This invention relates primarily to engine valving, and in particular, the reciprocating valves necessary for both the inake of air/fuel mixture into, and the expelling of exhaust gases out of the combustion chambers of conventional internal combustion engines, wherein the intake and exhaust valves incorporate vents in order to vastly improve the flow volume of the intake and exhaust valves.

In order to obtain the maximum power output of conventional internal combustion engines it is necessary to maximize flow volume of the air/fuel mixture and exhaust gases to and from the combustion chamber. This is performed by reciprocating intake and exhaust valves which are actuated by a cam transferring reciprocating motion to a rocker arm that is situated atop the valve stem and the springs and retainers of the valve.

The invention disclosed herein is an intake or exhaust valve for the intake and exhaust ports of the head of engines that will automatically take in and expell atmosphere in two stages and will create two passage ways, instead of one, to allow more atmosphere in and out of the combustion chamber, thereby maintaining maximum engine performance at all engine speeds.

The vented valve is designed with an inner valve and an outer or main valve. Both are circular in shape, with the inner valve having a longer stem of a smaller radius to extend above the outer valve and incorporating its own spring retainer and lock system and a heavy duty clip or stop disc below the retainer, and controlled by its own valve spring.

As the inner valve is depressed by the rocker arm it moves inside the outer valve stem hole (which now acts as a valve guide for the inner valve) opening the sealed vents in the base of the outer valve, allowing air/fuel mixture in or exhaust gases out of the combustion chamber.

When the slack is taken up between the inner valve stop disc, which is below the inner valve retainer, the pressure exerted on the inner valve by the rocker arm is tranferred to the outer or main valve and it begins to be depressed, moving inside its respective valve guide. At this point both valves are open, allowing two passages for air/fuel mixture or exhaust gases to move through. Since air and fluids will always find the shortest path of travel when forced through an opening, this will allow for highly increased flow volume, thereby greatly increasing the performace and power of internal combustion engines. In addition, this will cause two different speeds of atmospheric movement by creating a vortexial storm or swirl effect for better fuel atomization. The result is more power and better fuel efficiency than can be realized with state of the art valve arrangements.

DETAILED DESCRIPTION

Figure 1:
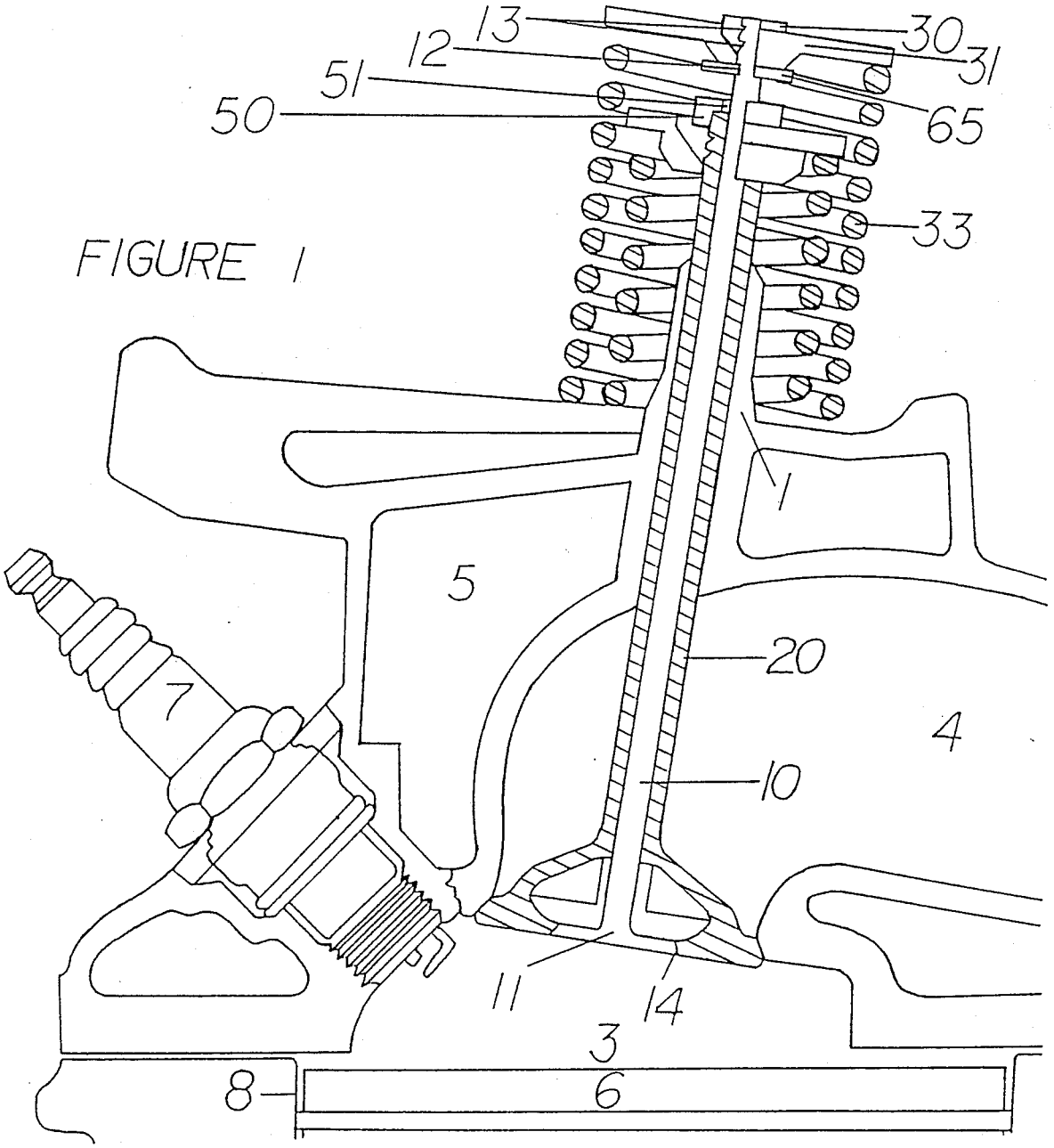
FIG. 1 is a sectional front view of a typical internal combustion engine comprising the vented valve assembly illustrating the inner workings and design of the vented chamber and the springs, retainer, and lock systems and other various components during the resting position.
Figure 2:
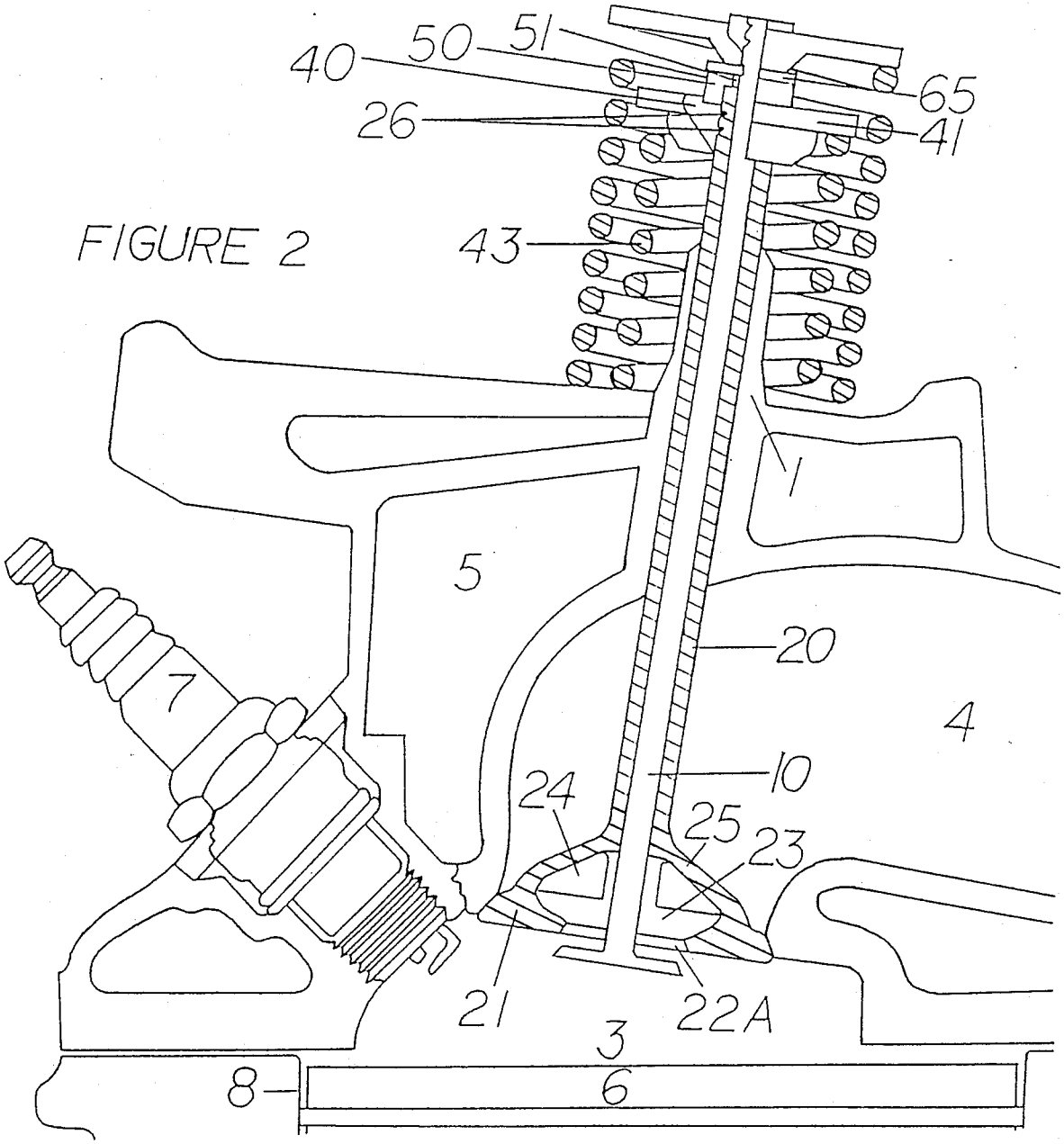
FIG. 2 is a sectional front view of a typical internal combustion engine comprising the vented valve assembly with the inner valve depressed to the fully open position, and the outer valve in a resting or fully closed position.
Figure 3:
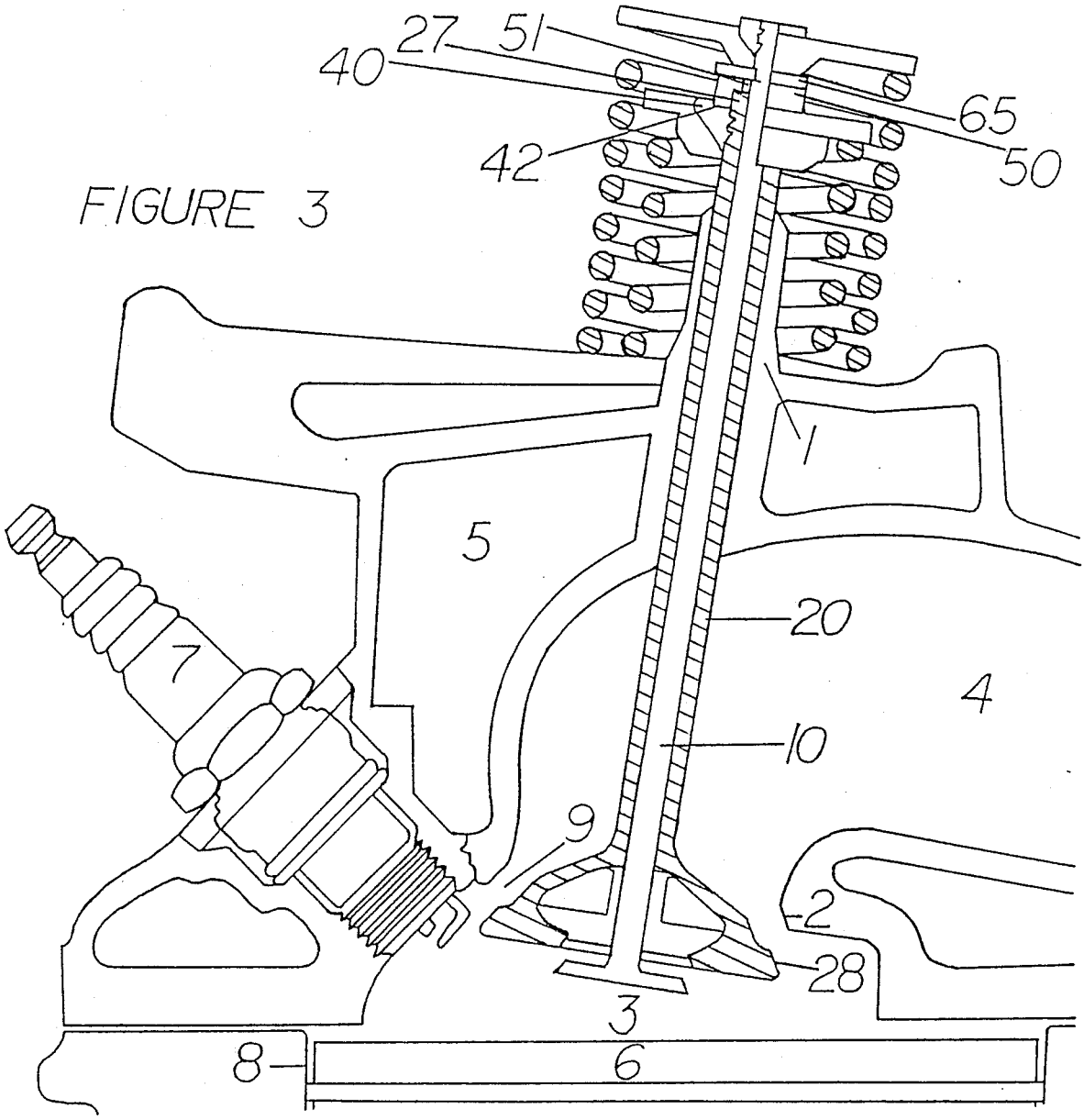
FIG. 3 is a sectional front view of a typical internal combustion engine comprising the vented valve assembly with both the inner and the outer valves in their fully depressed or open position.

As illustrated by FIGS.1, 2 and 3, the valve mechanism, #10 and 20, is placed into its respective valve guide, #1, and the valve guide is part of the overall head of the engine, #5. The valve mechanism controls the flow of atmosphere through the port, #4, to and from the combustion chamber, #3, by opening and closing at predetermined time sequences. The piston, #6, moves up and down in its cylinder, #8, in a predetermined time sequence with the valve mechanism, to push or pull atmosphere to or from the port, #4, depending on whether it is an exhaust or an intake valve. The ignition of the compressed air/fuel mixture is controlled by the spark plug, #7.

Also, as illustrated in FIGS. 1, 2 and 3, the valve is formed of two main members, each a distinct and different valve in its own right, but both required to make up the composite valve assembly. For purposes of easy distinction, the central member, FIG. 1-#10, will be referred to as the inner valve, and the main member, FIG. 1-#20, will be referred to as the outer valve.

Figure 4:
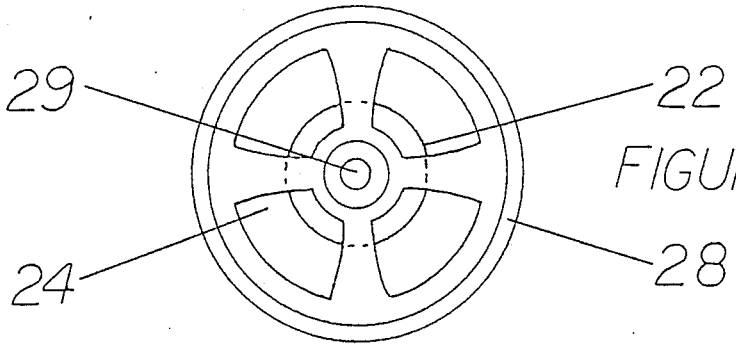
FIG. 4 is a plan view of the outer valve, without springs and inner valve, to illustrate one of the many possible designs of the vents in the outer valve.
Figure 5:
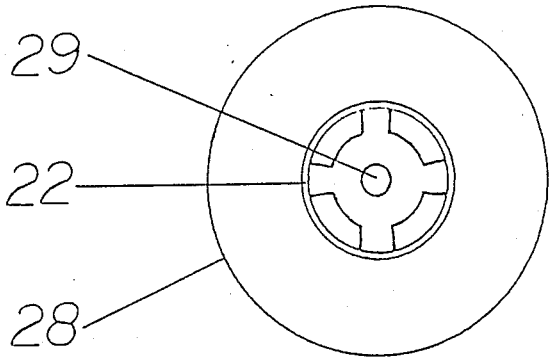
FIG. 5 is a bottom view of the outer valve, without the inner valve, to illustrate where the inner valve is placed and the inner passage way of the outer valve.

As illustrated in FIGS. 1,4 and 5, the inner valve, FIG. 1-#10, is constructed with a base, FIG. 1-#11, which could incorporate many different traditional internal combution engine valve designs as to the shape of the base. The base of the inner valve, FIG. 1-#11, is formed with an angle (or angles) cut throughout the circumference of its side portion, FIG. 1-#14. This angle (or angles) corresponds with the angle (or angles) cut into the circumference or seat of the center hole in the base of the outer valve, FIGS. 2 and 5-#22, so as to form a complete seal when mated. The inner valve has a stem, FIG. 1-#10, attached to its base, FIG. 1-#11, that is inserted through a hollow, FIG. 5-#29, that runs through the length of the outer valve stem, FIG. 1-#20. The inner valve stem, FIG. 1-#10, is long enough to protrude above the outer valve stem, FIG. 1-#20, and the inner valve seal assembly, FIG. 1-#50 and 51, and still have space for movement between the inner valve seal assembly, FIG. 1-#50 and 51, and the stop disc, FIG. 1-#65, located directly below the inner valve spring retainer assembly, FIG. 1-#30 and 31. The inner valve stem has machined grooves, FIG. 1-#12, to accept the stop disc or stop clip, FIG. 1-#65. It also has machined grooves, FIG. 1-#13, to accept spring retainer locks, FIG. 1-#30. The inner valve has spring retainer locks, FIG. 1-#30, and a spring retainer, FIG. 1-#31, attached to it at the top of the stem, FIG. 1-#10. This is so that upward pressure from the outer Coil spring, FIG. 1-#33, will remain constant against the inner valve until depressed, FIG. 2.

As illustrated in FIGS. 2,4 and 5, the outer valve, FIG. 2-#20, has a hollow stem, FIGS. 4 and 5-#29, large enough to accept the inner valve stem, FIG. 2-#10, and is constructed with a base, FIG. 2-#21, that incorporates a hole with an angled seat area on its inside edge, FIGS. 2 and 5-#22, to seat the inner valve. There is a cavity, FIG. 2-#23, above the inner valve seat that leads to vents, FIG. 2-#24, on the top or port side of the base of the outer valve, FIG. 2-#25, These vents are meant to allow communication between the port and combustion chamber.

As illustrated in FIGS. 3,4 and 5, the outer valve is constructed with a base that could incorporate many different designs as to the shape of the base, and has an angle or angles cut throughout the circumference of the outside edge of the base, FIGS. 3,4 and 5-#28, that corresponds with the angle or angles cut into the port seat area, FIG. 3-#2.

As illustrated by FIG. 2, the outer valve has a stem, FIG. 2-#20, extending from its base through the valve guide, FIG. 2-#1, affixed in the head portion of internal combustion engines. The outer valve also has machined grooves, FIG. 2-#26, to accept spring retainer locks, FIG. 2-#40. The outer stem protrudes above the spring retainer and lock assembly, FIG. 2-#40 and 41, to accept an inner valve stem seal assembly, FIG. 2-#50 and 51, and to transmit pressure from the inner valve stem stop disc, FIG. 2-#65, when depressed to the top of the outer valve stem, FIG. 2-#20, via the inner valve stem seal assembly, FIG. 2-#50 and 51.

The outer valve has spring retainer locks, FIG. 2-#40, and a spring retainer, FIG. 2-#41, attached to it at the top of the stem, FIG. 2-#20. This is so that upward pressure from the inner coil spring, FIG. 2-#43, will remain constant until depressed, FIG. 3.

As illustrated in FIG. 3, the outer valve spring retainer lock, FIG. 3-#40, could be machined with an indentation, FIG. 3-#42, in its inner top portion to accommodate the portion of the inner valve stem seal, FIG. 3-#50, that overlaps the top portion of the outer valve stem, FIG .3-#27.

In the preferred embodiment the inner valve stem seal assembly is affixed atop the outer valve stem, FIG. 3-#27, and consists of an inner, FIG. 3-#51, and an outer, FIG. 3-#50, piece. The outer piece is constructed of a hard, durable, metal material to withstand the pounding force of the inner valve stop disc, FIG. 3-#65, upon it. The inner piece, FIG. 3-#51, is constructed of a soft, pliable material and is designed to apply slight pressure around the inner valve stem to partially seal it from oil splashing.

DETAILED OPERATION

As illustrated in FIG. 1, when the entire valve mechamism is in a resting position it provides a complete seal from the combustion chamber, FIG. 1-#3, for the port, FIG. 1-#4.

As illustrated by FIG. 2, when a cam is used to transfer reciprocating motion to a rocker arm, or when a cam is directly applied to depress the valve from the top of its inner valve stem in proper timing with the crank rotation, the inner valve, FIG. 2-#10, begins to open without affecting the position of the outer valve, making a passage way for air/fuel mixture or exhaust gases to flow through the vents in the outer valve, FIG. 2-#24, and the outer valve cavity, FIG. 2-#23, into or out of the combustion chamber. This initial flow is charged somewhat due to the low pressure point that is created at this stage.

As illustrated by FIG. 3, as the rocker arm or cam continues to depress the inner valve, FIG. 3-#10, the space between the stop disc, FIG. 3-#65, and the inner valve stem seal, FIG. 3-#50, is taken up, and pressure from the movement of the inner valve, FIG. 3-#10, is transferred to the outer valve, FIG. 3-#20. At this point both the inner and the outer valves move together leaving the inner valve open and opening the outer valve, creating a second, larger opening, FIG. 3-#9, for the air/fuel mixture or exhaust gases to flow into or out of the combustion chamber, FIG. 3-#3.

At this point the atmosphere coming from the two separate passages collide. Since the atmosphere coming from the inner valve is moving more quickly than that from the outer valve a storm or swirl effect occurs promoting fuel atomization, which allows for more power and fuel efficiency from a given amount of fuel at all R.P.M. ranges.

As illustrated by FIGS. 4 and 5, the best improvement is due to the dual passage ways created, FIGS. 4 and 5-#22 and 28, in the process of operation. These allow for a substantial increase in flow for a substantial increase in power and torque in all R.P.M. ranges.

The same process occurs, only in exact reverse, when pressure is released from the valve mechanism and it begins to close.

It will be apparent to those skilled in the art that various changes can be made in the size, shape, type, number and arrangement of parts described hereinbefore without departing from the spirit of this invention and the scope of the afforded claims.

I claim:

1. A reciprocating value for internal combustion engines, the value comprising:

(A) an outer value having a base and a stem arranged to releasably intercept the conventional openings between a cylinder and its associated intake and exhaust ports, the outer value being configured with vents through its base, the vents communicating between said cylinder and said ports, the said outer valve including a hollow stem;

(B) an inner valve means associated with said outer valve to releasably intercept said vents through said outer value base, said valve means comprising an inner valve configured with a valve stem that is carried within the hollow stem of the outer value, and the inner valve includes a base arranged to releasably seal to outer valve base opening from communicating between said cylinder and port in a predetermined timed sequence;

(C) control means for selectively controlling the operation of the said value means in a predetermined timed sequence, and a stop disc inserted in a groove directly below the said inner valve spring retainer assembly;

(D) the said inner valve comprising a stop disc inserted in a groove directly below the said inner valve spring retainer assembly for transferring the said inner valve's depressed motion to the said outer valve.

2. The reciprocating valve of claim 1 wherein the sealing means of the inner valve stem is effected by a seal assembly affixed atop the outer valve stem and spring retainer locks.

3. The reciprocating valve of claim 2 wherein the said outer valve spring retainer locks include an indentation in their top face to accept the inner valve stem seal assembly.

4. A reciprocating valve for internal combustion engines, the valve comprising:

(A) an outer valve means having a base and a stem arranged to releasably intercept the conventional openings between a cylinder and its associated intake and exhaust ports, the outer valve being configured with a means defining at least one vent through its base, the said vent(s) communicating between said cylinder and said ports, the said outer valve including a hollow stem;

(B) an inner valve means associated with said outer valve to releasably intercept said vent(s) through said outer valve base, said valve means comprising an inner valve configured with a valve stem that is carried within the hollow stem of the outer valve, and the inner valve including a base arranged to releasably seal the said means defining at least one vent in the outer valve base from communicating between said cylinder and ports in a predetermined timed sequence;

(C) control means for selectively controlling the operation of the said valve means in a predetermined timed sequence;

(D) lubricity control means for effectively controlling the movement of lubricant into, within, and out from between the said outer valve hollow stem and said inner valve stem.

5. The reciprocating valve of claim 4 including an inner valve stop means below and part of the said inner valve spring retainer assembly, for transferring the said inner valve's depressed motion to the said outer valve.

* * * * *